US007644778B2

(12) United States Patent
Rossanigo

(10) Patent No.: US 7,644,778 B2
(45) Date of Patent: Jan. 12, 2010

(54) TANKS FOR RAILWAY TRUCKS TO TRANSPORT CRUSHED STONES, GRAVEL AND OTHER MATERIALS, PARTICULARLY FOR RAILROAD BALLAST RESTORING MACHINES, TRUCKS FOR RAILROAD BALLAST RESTORING MACHINES COMPRISING SAID TANKS AND PROCESS FOR OBTAINING SAID TRUCKS

(76) Inventor: Cesare Rossanigo, c/o Bugnion S.p.A., Viale Lancetti 17, 20158 Milano (IT)

( * ) Notice: Subject to any disclaimer, the term of this patent is extended or adjusted under 35 U.S.C. 154(b) by 0 days.

(21) Appl. No.: 11/664,891

(22) PCT Filed: Oct. 6, 2005

(86) PCT No.: PCT/IB2005/003229

§ 371 (c)(1),
(2), (4) Date: Apr. 6, 2007

(87) PCT Pub. No.: WO2006/038122

PCT Pub. Date: Apr. 13, 2006

(65) Prior Publication Data

US 2009/0008106 A1 Jan. 8, 2009

(30) Foreign Application Priority Data

Oct. 8, 2004 (IT) ..... MI04A1909

(51) Int. Cl.
*E01B 27/06* (2006.01)
*B65G 67/10* (2006.01)

(52) U.S. Cl. ..... 171/16; 414/339

(58) Field of Classification Search ..... 37/301, 37/104; 414/339, 502; 104/2, 5, 10, 12; 171/2, 7–16
See application file for complete search history.

(56) References Cited

U.S. PATENT DOCUMENTS

| | | | | |
|---|---|---|---|---|
| 2,381,783 | A * | 8/1945 | Stevenson | 414/489 |
| 4,794,862 | A * | 1/1989 | Theurer | 104/7.2 |
| 5,099,766 | A * | 3/1992 | Whitaker, Jr. | 104/2 |
| 5,203,662 | A | 4/1993 | Theurer et al. | |
| 5,277,538 | A * | 1/1994 | Theurer et al. | 414/505 |
| 5,727,474 | A | 3/1998 | Theurer et al. | |
| 5,993,130 | A | 11/1999 | Theurer et al. | |
| 5,993,131 | A | 11/1999 | Theurer et al. | |

* cited by examiner

*Primary Examiner*—Robert E Pezzuto
(74) *Attorney, Agent, or Firm*—Pearne & Gordon LLP

(57) ABSTRACT

A truck (1) for a railroad rehabilitation machine comprises a railway truck (3) and a tank (2) resting on the railway truck (3) in a removable manner. The tank (2) comprises a holding structure (5) extending along a predetermined direction (X), at least one first conveyor (8) mounted within the holding structure (5) to transport incoherent material along the predetermined direction (X) internally of the holding structure (5), and an element (22) for laying the holding structure (5) on the truck (3) for railway transport. A process for making a truck for a railway rehabilitation machine comprises the steps of arranging a railway truck (3) having a support platform (4), arranging a tank (2) for trucks of railroad rehabilitation machines in accordance with the invention and laying the tank (2) on the platform (4) of the railway truck (3) in a removable manner.

21 Claims, 5 Drawing Sheets

TANKS FOR RAILWAY TRUCKS TO TRANSPORT CRUSHED STONES, GRAVEL AND OTHER MATERIALS, PARTICULARLY FOR RAILROAD BALLAST RESTORING MACHINES, TRUCKS FOR RAILROAD BALLAST RESTORING MACHINES COMPRISING SAID TANKS AND PROCESS FOR OBTAINING SAID TRUCKS

FIELD OF THE INVENTION

The present invention relates to a tank for railway trucks to transport crushed stones, gravel and other materials, particularly for railroad ballast restoring machines, a truck for railroad ballast restoring machines comprising said tank and a process for obtaining said truck.

The present invention applies to the railway industry sector and in particular to the technical field of the machines intended for formation, maintenance and dismantling of railroads.

BACKGROUND OF THE INVENTION

For the purpose of renewing long track sections, the operations to be carried out are, as known, removal of the incoherent material interposed between the sleepers, typically crushed stones and gravel, and replacement of same with new material. This operation relies on known machines for ballast restoration or rehabilitation machines that, running at low speed on the track to be rehabilitated, continuously remove the crushed stones and gravel therefrom and discharge them into suitable trucks coupled up to the rehabilitation machine itself. Associated with each rehabilitation machine is a plurality of trucks, usually about twenty, forming a true train. Each truck for railroad rehabilitation machines of known type comprises a tank provided with wheels with rail gauge corresponding to the track to be rehabilitated. Installed on the tank bottom is a conveyor belt formed of mutually hinged rigid plates capable of supporting the weight of the debris gathered by the rehabilitation machine. The conveyor belt of the truck that is the closest to the rehabilitation machine receives the gravel and carries it, by means of the conveyor belt, to the subsequent truck so that the last truck in the row is filled the first and then all the other trucks in succession are filled. To carry out gravel discharge from a tank to another, each truck further comprises an auxiliary conveyor belt projecting in cantilevered fashion from the rear region of each tank. The auxiliary conveyor belt receives the gravel from the conveyor belt contained in the tank and lifts it until it lets the gravel fall into the subsequent truck.

Disadvantageously, the trucks of the above described type must be built to size, based on the gauge of the track to be rehabilitated. Therefore, each of the firms performing the rehabilitation operations referred to above must have at its disposal the same number of sets of trucks, each formed of about twenty elements, as the types of tracks on which each firm usually works. The cost of each truck that is already very high by itself because it also comprises the actuating unit of said truck defined by the bogies and possibly by a motor, multiplied by the number of the necessary trucks gives rise to a very high investment for the concerned firms.

In addition, due to the very high weight and bulkiness, the known trucks when not in use must be left on rented track sections the cost of which are to be added to those for purchase and servicing.

Finally, since the auxiliary conveyor belt keeps stationary and projects behind the last truck of the train, the presence of a safety railway truck is necessary which must be provided with the platform alone and coupled up behind the last truck for the rehabilitation machine. The safety truck prevents accidental impacts of other means running on rails, such as railway working machines or trains, against the projecting portion of the last truck for the rehabilitation machine. The presence of the safety truck makes the working times longer because, when the last truck is to be uncoupled from the fully loaded train it is also necessary to detach the safety truck and temporarily park it on an auxiliary track, to enable moving away of the filled truck.

Under this situation, the technical task underlying the present invention is to devise a tank for trucks of railroad rehabilitation machines, a truck for railroad rehabilitation machines and a process for making said truck which are able to obviate the mentioned drawbacks.

In particular it is an aim of the present invention to devise a tank for trucks of railroad rehabilitation machines that can be used on tracks with different gauges.

Another aim of the invention is also to propose a tank for trucks of railroad rehabilitation machines that can be stored in relatively reduced spaces and without involving renting and occupation of expensive track sections.

It is a further aim of the present invention to propose a tank for trucks of railroad rehabilitation machines that can also enable easy road transport, as well as transport by sea or by air.

Finally, it is an aim of the present invention to make available a truck for railroad rehabilitation machines and a method of making the same involving very reduced manufacturing and servicing costs as compared with those of the trucks of the known art.

SUMMARY OF THE INVENTION

The technical task mentioned and the aims specified are achieved by a tank for trucks of railroad rehabilitation machines having the features set out in the claims, by a truck for railroad rehabilitation machines comprising such a tank and by a process for manufacturing said truck.

BRIEF DESCRIPTION OF THE DRAWINGS

The description of a preferred but not exclusive embodiment of a tank for trucks of railroad rehabilitation machines and of a truck for railroad rehabilitation machines comprising said tank is given hereinafter by way of non-limiting example and illustrated in the accompanying drawings, in which.

DETAILED DESCRIPTION OF THE PREFERRED EMBODIMENTS OF THE INVENTION

Figure 1:
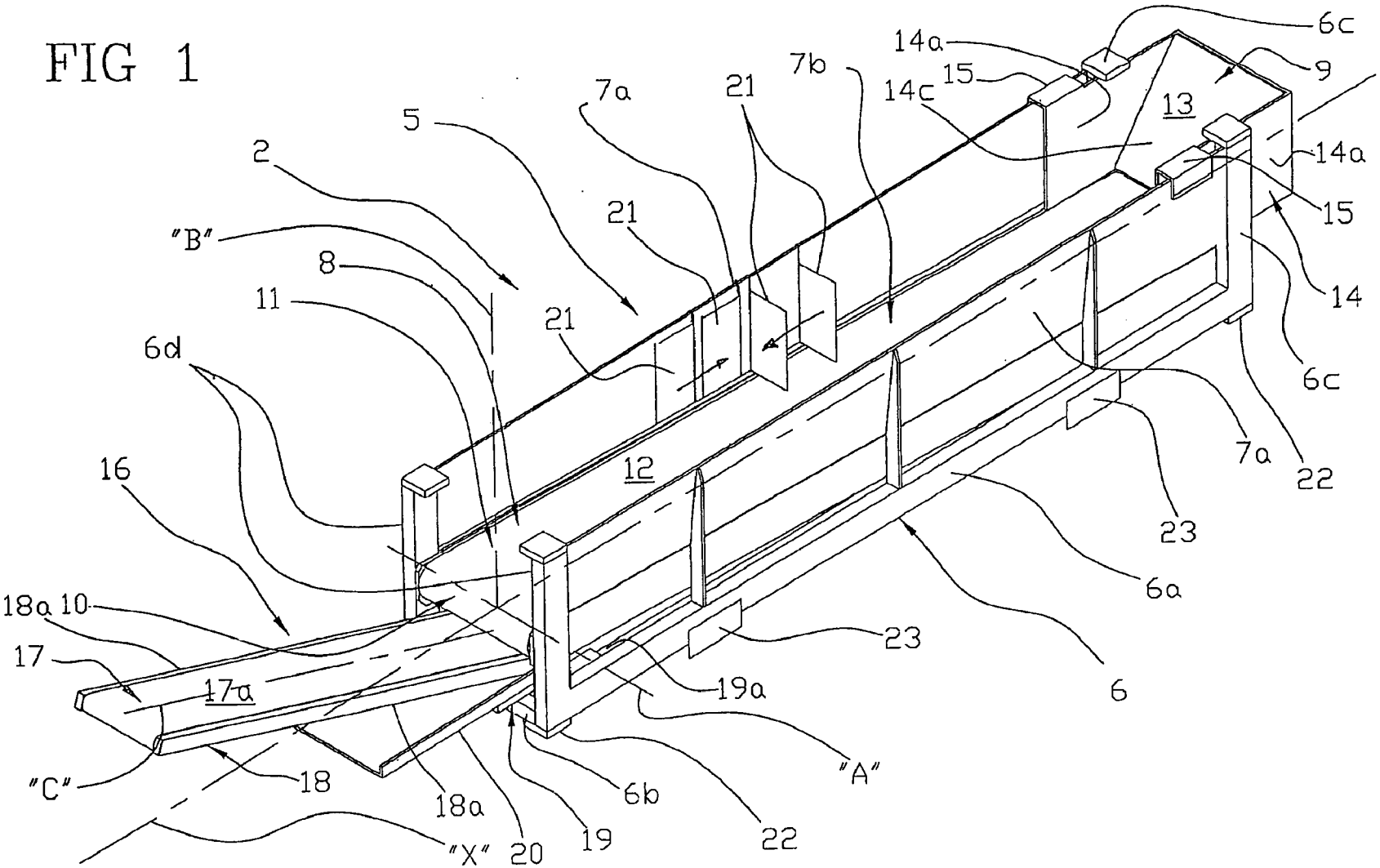
FIG. 1 is a perspective view of a tank for trucks of railroad rehabilitation machines in accordance with the invention, in a first operating configuration.

With reference to the accompanying drawings, a railway truck for transporting gravel or other materials preferably for railroad rehabilitation machines in accordance with the present invention has been generally identified by reference numeral 1.

Figure 2:
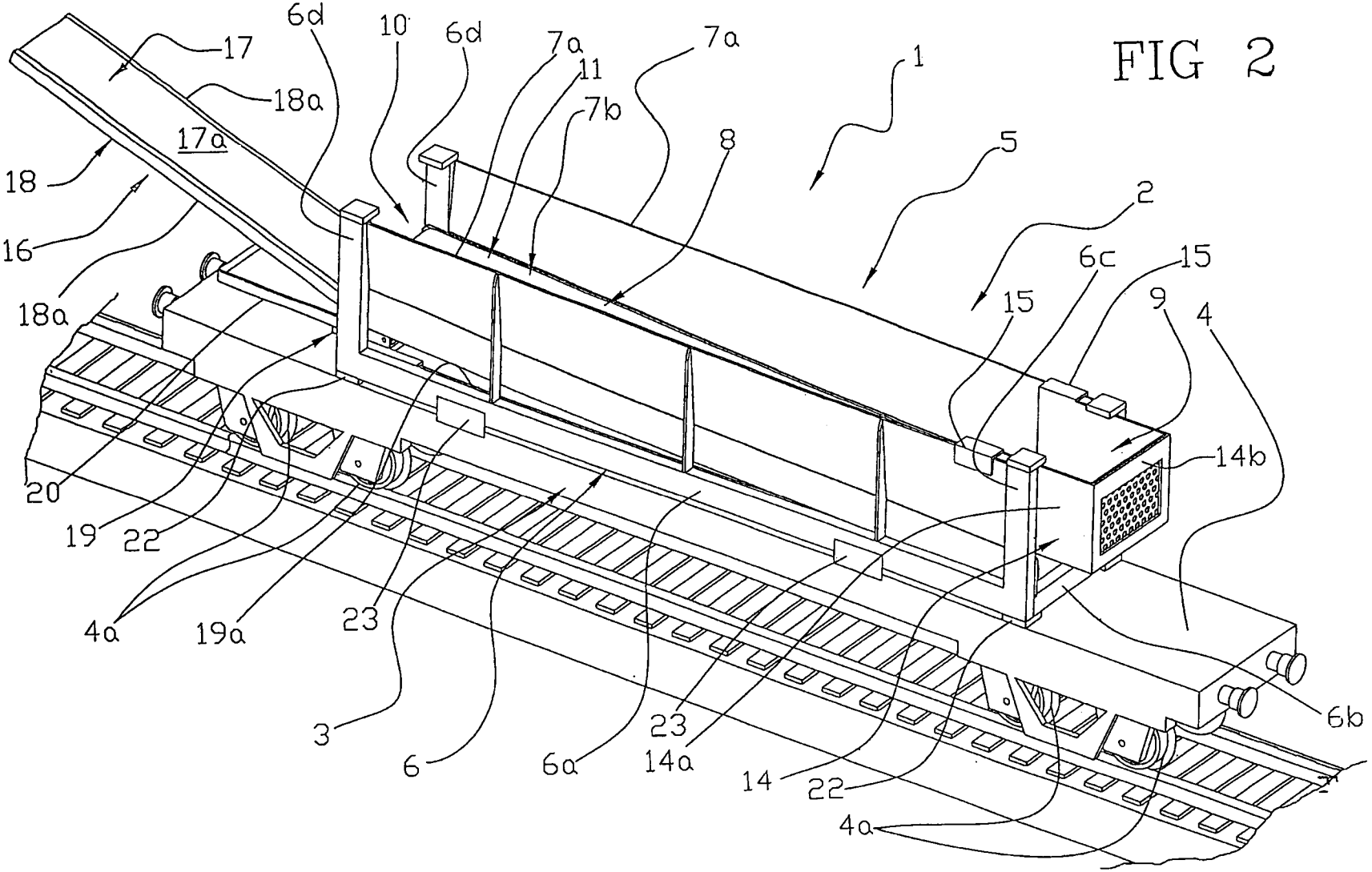
FIG. 2 is a perspective view of a truck for railroad rehabilitation machines in accordance with the present invention, provided with the tank shown in FIG. 1 in the first operating configuration.
Figure 3:
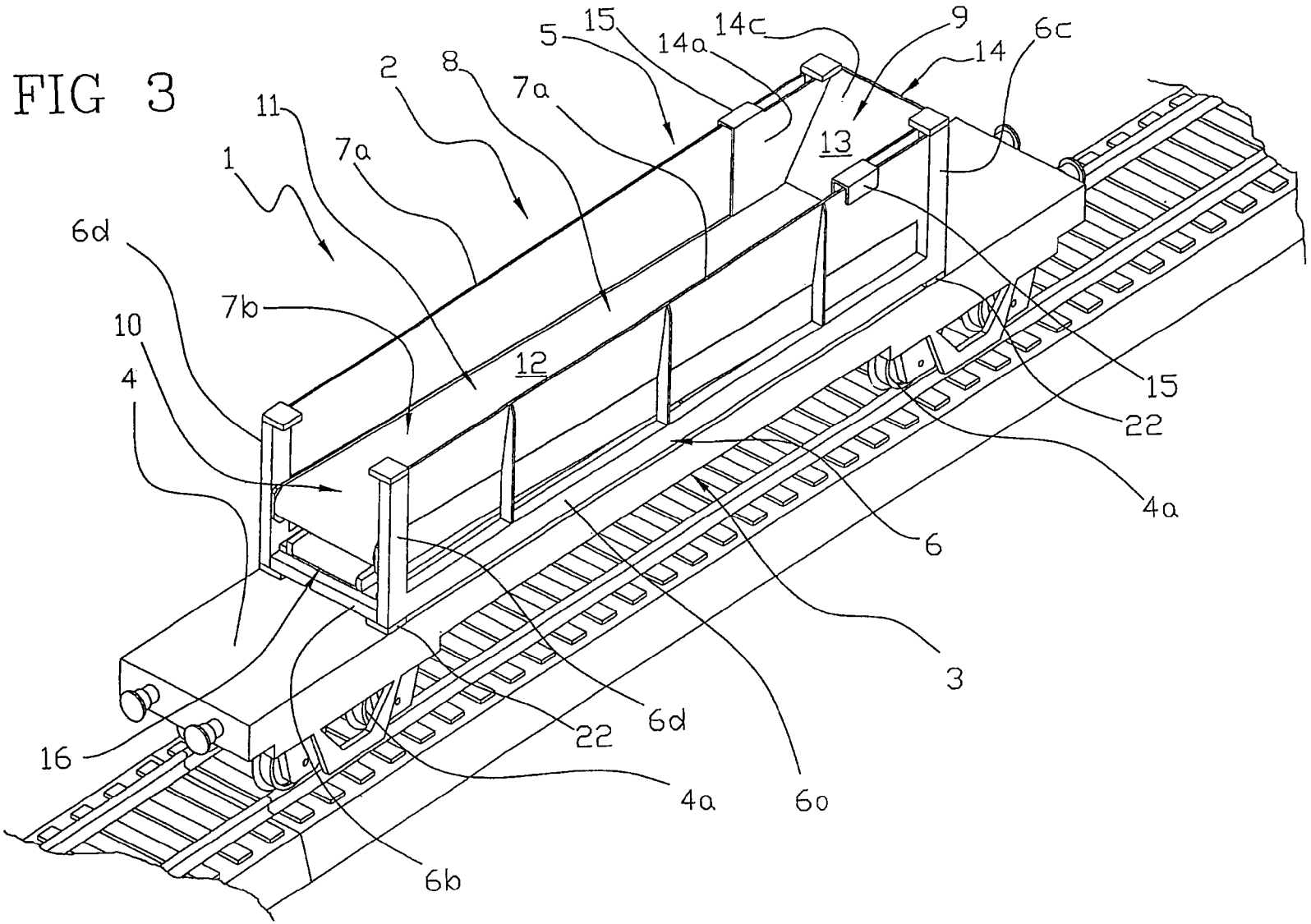
FIG. 3 shows the truck for railroad rehabilitation machines depicted in FIG. 2 with the tank seen in FIG. 1 in a second operating configuration.

The truck for railroad rehabilitation machines 1 is advantageously made up of a tank for railroad rehabilitation machines resting in a removable manner on a railway truck 3, preferably but not exclusively of the standard type. By railway truck 3 of the standard type it is intended in the course of the present specification, a railway truck of known type and of current production which is usually 14 or 19 meters long; this truck in its common use is designed to receive containers of different shapes and sizes for transport of same on rail. The standard railway truck 3 is therefore provided with a support platform that in the present invention is designed to receive the tank 2 for railroad rehabilitation machines, and with wheels 4*a* for engagement on the rails of a track (FIGS. 2 and 3). While use of standard railway trucks is preferred, the possibility of making railway trucks dedicated to the support of said tank 2 also falls within the scope of the present invention.

Tank 2 comprises a holding structure 5 mainly extending along a predetermined direction "X" and having a pair of opposing side walls 7*a* and a bottom wall 7*b*. The side walls 7*a* extend along the predetermined direction "X" and the bottom wall 7*b* closes the tank 2 at the lower part thereof.

In the embodiment shown, the holding structure 5 comprises a perimetral frame 6 containing and supporting the side walls 7*a* and bottom wall 7*b*. In more detail, the perimetral frame 6 is defined by a rectangular base comprising two longitudinal beams 6*a* parallel to each other and substantially aligned with the predetermined direction "X" and two transverse beams 6*b* joining the ends of the longitudinal beams 6*a*. Vertically extending from the four corners of the rectangular base are four uprights 6*c*, 6*d*. Therefore each of the side walls 7*a* extends between two uprights 6*c*, 6*d* connected to the same longitudinal beam 6*a*.

Mounted on the bottom of the holding structure 5, between the side walls 7*a* is at least one first conveyor 8. The task of said first conveyor 8 is to transport the incoherent material removed from the railroad ballast, commonly defined as debris, along the predetermined direction "X" within the holding structure 5. The material is transported between an inlet region 9 to the holding structure 5 into which it is directly discharged from the rehabilitation machine for example, and an outlet region 10 from the holding structure 5.

As shown in the figures, the inlet region 9 is confined by two of the above mentioned uprights that, for the sake of clarity, are defined as front uprights 6*c*, whereas the outlet region 10 is confined by the remaining two uprights identified for clarity as rear uprights 6*d*.

Preferably, the first conveyor 8 comprises a first conveyor belt 11 passing over at least one first and one second rollers of known type and not shown in the accompanying drawings because concealed by the first belt 11 itself.

In the preferred embodiment the first roller is rotatably installed between the two front uprights 6*c* with its rotation axis perpendicular to said uprights 6*c* and the second roller is rotatably mounted between the two rear uprights 6*d*, parallel to the first roller.

The first conveyor belt 11 has a rest surface 12 for the incoherent material which constitutes the bottom wall 7*b* and from the sides of which the opposing side walls 7*a* extend. The rest surface 12 is preferably inclined from bottom to top starting from the inlet region 9 towards the outlet region 10.

Advantageously, to enable storage of a great amount of incoherent material, the side walls 7*a* have a hopper-like configuration and diverge upwards from each other, on moving away from the first conveyor 8.

In addition, a chute 13 is present at the inlet region 9 and it is used to feed the incoherent material discharged from tank 2 to the first conveyor 8.

The first conveyor 8 is actuated by a motor of a type known by itself and therefore not further described or illustrated, which is advantageously contained in a box-shaped structure 14 installed close to the inlet region 9. The motor is operatively connected to the first conveyor 8 by a mechanical connection with the first roller of the first belt 11, for example.

The box-shaped structure 14 is placed at a raised position relative to the first conveyor 8 and the chute 13 is defined by a wall of the box-shaped structure 14 itself.

In more detail in terms of construction, the box-shaped structure 14 has two side walls 14*a* which are substantially parallel and face the side walls 7*a* of the holding structure 5, a front wall 14*b*, perpendicular to the side walls 14*a* and possibly provided with ventilation openings for the motor, a non-visible lower wall parallel to the rest surface 12 of the conveyor belt 11, and a sloping wall 14*c* joining the upper edge of the front wall 14*b* to the rear edge of the lower wall. The lower wall is further provided with suitable openings to enable mechanical connection of the motor to the conveyor 8. The sloping wall 14*c* defines the chute 13.

In addition and advantageously, the box-shaped structure 14 is movable, through suitable actuators, between a first position at which it lies fully contained in the holding structure 5 and over the first conveyor 8 to facilitate transport of the tank 2, and a second position at which it lies at least partly out of the holding structure 5 to enable full utilisation of the first conveyor 8.

To this aim, in the embodiment shown the side walls 14*a* of the box-shaped structure 14 have hooking elements 15 slidably secured to the side walls 7*a* of the holding structure 5. In addition, the side walls 14*a* of the box-shaped structure 14 extend towards the outlet region 10 for the incoherent material beyond the sloping wall 14*c*. In this manner, when the box-shaped structure 14 is in the first position, the lower wall is set over the rest surface 12 of the first belt 11, the front wall 14*b* is flush with the front uprights 6*c* and the side walls 14*a* are fully contained between the side walls 7*a* of the holding structure 5. When the box-shaped structure 14 is in the second position, the lower wall is no longer set over the rest surface 12, so that the whole conveyor belt 11 can be used for laying of the incoherent material. In this configuration, the chute 13 is continuously connected to the rest surface 12 of the first belt 11 and the side walls 14*a* of the box-shaped structure 14 extend beyond the side walls 7*a* of the holding structure 5.

The tank 2 further comprises a second conveyor 16 secured to the holding structure 5 in the vicinity of the outlet region 10, the function of which is to convey the incoherent material carried by the first conveyor 8 away from the outlet region 10 towards another tank being part of the train of the railroad rehabilitation machine, or towards a not specific discharge region.

Advantageously, the second conveyor 16 is movable between a first operating position at which it projects in cantilevered fashion from the holding structure 5 (FIG. 2) and a second operating position suitable for transport of tank 2 in which it lies in a retracted position in the holding structure 5 itself (FIG. 3). Preferably, in the second operating position, the second conveyor 16 lies under the first conveyor 8.

In the preferred embodiment shown, the second conveyor 16 too is defined by a second conveyor belt 17 passing over at least one third and one fourth roller, not shown because hidden by the belt 17 itself. Both the first 11 and second 17 conveyor belts can be of the type commonly used in mining enterprises. These belts are formed of a metal casing covered with a rubber covering.

In more detail, with reference to FIG. 1, the second conveyor 16 comprises a supporting frame 18 defined by two longitudinal beams 18*a* parallel to each other and mutually connected by crosspieces or other equivalent elements not shown. Interposed at the ends of the longitudinal beams 18*a* is the third and fourth rollers on which the second belt 17 is wrapped.

The supporting frame 18 is movable between a first extended position external to the holding structure 5, corresponding to the first position of the second conveyor 16, and a second retracted position corresponding to the second position of the second conveyor 16.

This movement is obtained through a slide 19 slidable under the first conveyor 8 on guides 19*a* preferably formed on the longitudinal beams 6*a* of the perimetral frame 6. The supporting frame 18 is secured to slide 19 and runs together with the latter.

Furthermore, the second conveyor 16 can be orientated with respect to the holding structure 5 and the first conveyor 8, in order to enable discharge of the debris at any place close to the outlet region 10.

In particular, to enable discharge of the incoherent material into an adjacent tank or in any case in a raised place relative to the rest surface 12 of the first conveyor 8, the supporting frame 18 is movable around a first horizontal axis "A" located in the vicinity of the outlet region 10. This rotation enables the second conveyor belt 17 to be orientated in an inclined position from bottom to top starting from the first conveyor 8.

In addition and preferably, the supporting frame 18 is movable around a second vertical axis "B" located in the vicinity of the outlet region 10 to enable rotation of the second conveyor belt 17 in a horizontal plane.

In the preferred embodiment shown, the above mentioned movements around the first and second axes "A", "B" are obtained through a supporting body 20 defined by a plate which is rotatably installed on slide 19 around the second vertical axis "B". In addition, the end of the supporting frame 18 close to the third roller is hinged on the supporting body 20 around the first horizontal axis "A". Suitable driving means of known type and not shown are mounted between the supporting body 20 and the supporting frame 18 to cause rotation of the second conveyor 8 around the second axis "B". Second driving means not shown is interposed between the supporting body 20 and slide 19 to cause rotation of the second conveyor 8 around the first axis "A". Finally, third driving means not shown is operatively connected to slide 19 to move it along the respective guides 19*a*.

In addition and advantageously, the supporting frame 18 is also movable around a third axis "C" that is orientated along the longitudinal extension of the second conveyor belt 17, to vary the inclination of the second belt 17 and prevent the incoherent material from falling, due to an inclination of the tank 2.

The inclination around the third axis "C" can alternatively be a rigid rotation of the whole rest surface 17*a* of the second conveyor belt 17 or a differentiated inclination in the different longitudinal sections. In the second case, the rest surface 17*a* is therefore susceptible of twisting around the third axis "C". The sections of the rest surface 17*a* of the second conveyor belt 17 close to the first conveyor belt 11 are advantageously maintained coplanar with the rest surface 12.

The tank 2 in addition can be provided with auxiliary thrust means 21 for the incoherent material which is movable on the rest surface 12 of the first conveyor belt 11 along the predetermined direction "X" (see FIG. 1).

The auxiliary thrust means 21 interferes with the incoherent material at least during moving forward from the inlet region 9 to the outlet region 10, to avoid formation of compact gravel blocks that, laying on the inclined side walls 7*a*, tend to keep stationary while the first conveyor belt 11 is sliding under them.

Preferably, the auxiliary thrust means 21 comprises a plurality of lugs that during moving forward from the inlet region 9 to the outlet region 10 extend over the rest surface 12 and transversely of the transport direction "X".

In the embodiment shown, lugs 21 extend from regions close to both the side walls 7*a* to the centre line of the first conveyor belt 11.

Preferably and in addition, lugs 21 are alternately movable along the transport direction "X" being moved by suitable hydraulic cylinders not shown, for example. In this case, during the return movement from the outlet region 10 to the inlet region 9 they lie parallel being substantially in contact with the side wall and not superposed on the rest surface 12, so that they do not interfere with the incoherent material that goes on moving towards the outlet 10 (in the example in FIG. 1 two lugs 21 have been shown in an operating position, i.e. pulled out and moving forward towards the chute 17 and two lugs 21 in a rest condition and movable towards the inlet region 9; obviously the representation is fictitious because lugs 21 will move simultaneously in the same direction, i.e. being all pulled out or all retracted and they can be present on one or both of the side walls).

Advantageously and unlike the trucks for railroad rehabilitation machines of the known art, the tank 2 being the object of the present invention further comprises means 22 for laying the holding structure 5 in a removable manner on a transport truck.

Preferably but not necessarily, the tank 2 further comprises means 23 known by itself and therefore only diagrammatically shown, to hook the holding structure 5 to the above mentioned transport truck, in a removable manner.

By transport truck it is intended either the above described railway truck 3 preferably of standard type with which the tank 2 is associated to form the truck for railroad rehabilitation machines being the object of the invention, or a specific truck for road transport, of the self-propelled or towed type.

Advantageously and as shown in FIG. 3 tank 2, when it is closed into the second operating position, has an extension along the transport direction "X" that is smaller than the length of a standard railway truck which is 14 or 19 meters long, to enable transport on the railway truck itself.

More advantageously, the holding structure 5 along the transport direction "X" has an extension of 12 meters or a smaller extension to enable installation of same on the platform of a non special road truck.

In the first operating position shown in FIG. 2, the holding structure 5 together with the second conveyor 16 has a longitudinal extension along the transport direction "X" that exceeds the length of the standard railway truck, to enable a correct operation of the first 8 and second 16 conveyors on said railway truck 3.

Figure 4:
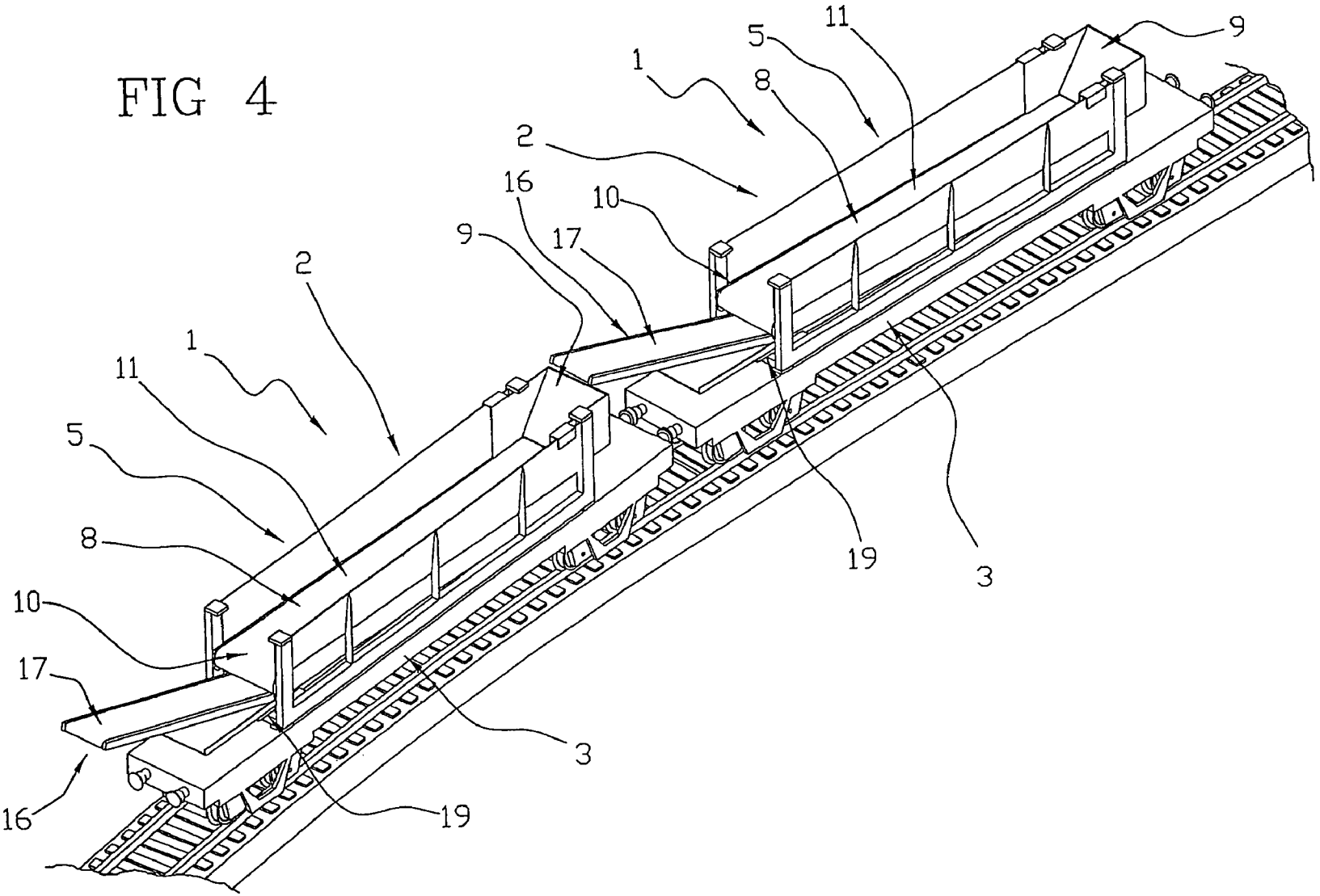
FIG. 4 shows two trucks in the operating configuration seen in FIG. 2 disposed after each other on a track.

To this aim, tank 2 is preferably mounted in a centred position on the respective railway truck 3 (FIGS. 2 and 3), so that, in the first operating position, the second conveyor 16 pulled out and inclined upwards projects from the overall dimensions of the railway truck 3 to partly overlap tank 2 mounted on the subsequent railway truck 3 (FIG. 4).

In a further embodiment (FIG. 3A) the trucks 1 comprise further conveyor means 50 mounted on top of tank 2 in a removable manner for example.

This conveyor means 50 shall comprise one or more conveyor belts 51 laying upon and secured to the front 6*c* and rear 6*d* uprights. The conveyor belts can have any sizes and can extend longitudinally even more than the underlying tanks being actuated in an independent manner by suitable motors not shown.

In use, based on the gauge of the track to be rehabilitated, tank 2 is mounted on a suitable railway truck 3 and possibly secured thereto by hooking means 23. The thus obtained trucks 1 for railroad rehabilitation machines form a train ahead of which the rehabilitation machine is positioned.

When, during the rehabilitating operation, the train is on a track section defining a bent, the second conveyor 16 of each of tanks 2 is rotated around the second axis "B" so that it keeps centred over the chute 13 of the subsequent tank 2. In addition, since the tracks at the bents are inclined, in order to counteract the centrifugal action acting on the trains running therealong, the second conveyor 16 is inclined or twisted around the third axis "C" so as to prevent part of the incoherent material gathered from laterally slipping and falling onto the track itself.

The material removed by the rehabilitation machine is brought, through conveyors 8, 15, from the truck 1 close to the rehabilitation machine itself to the last truck 1 of the train. When filling of the last truck 1 has been completed, the material fills the last but one truck 1 and, in succession, all the other trucks. The last truck 1 can be uncoupled from the train and brought to a place suitable for unloading of the material. Alternatively, the tank 2 of each of trucks 1 already filled is separated from the railway truck 3 on which it lies and brought to the place dedicated to disposal of debris.

In addition and advantageously, the second conveyor 16 of the last truck 1 of the train that stays idle is retracted in the respective tank 2 so that it does not dangerously project from the overall dimensions of truck 1. In this configuration, the buffers of the last truck 1 can therefore do their work in case of accidental impact with a railway truck which is moving close or with a train, for example.

When the rehabilitating operation has been completed, the tanks 2 are separated from the respective railway trucks 3, closed to form the second configuration and can therefore be stacked up in a suitable storehouse.

Figure 3A:
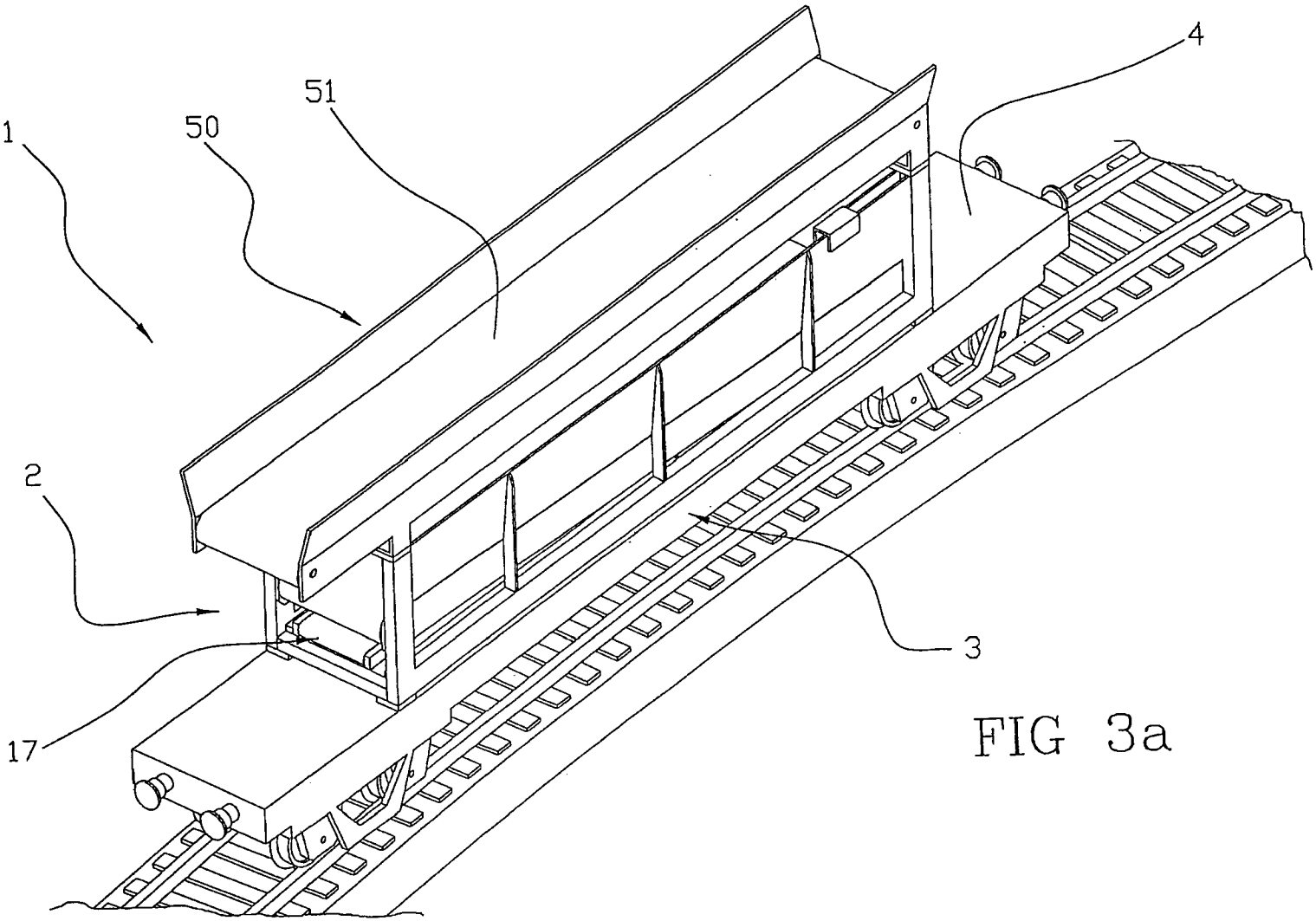
FIG. 3A shows an alternative embodiment of the truck in FIG. 3.

On the contrary, with the truck shown in FIG. 3A it will be possible to use the lower belts 12 for transport of the removed material, while belts 51 disposed at the upper part will cause an advancing movement of the new material to be laid so that the two operations can be performed simultaneously.

In this connection it will be recognised that for loading the upper belts 51 it will be sufficient to rotate one of the trucks through 180° so that the chute 17 is active in a front region exactly close to chutes 51.

The invention achieves the intended purposes and has important advantages.

It will be first of all appreciated that the truck for railroad rehabilitation machines being the object of the invention is of the modular type. In fact, the tank being the object of the invention as well, can be coupled with railway trucks of different lengths and gauges. This feature enables the cost of each truck for railroad rehabilitation machines to be drastically reduced, above all if standard railway trucks are used, because the structure resting on the tracks is already available on the market at relatively low costs.

In addition, the modular character itself allows a reduction in the necessary investment to purchase complete trains adapted for use on tracks with different gauges. In fact, it is sufficient to buy a single set of tanks that will be coupled each time with railway trucks provided with the desired gauge.

Furthermore, the tanks can be stored in places other than the rented tracks and can be advantageously piled up so that they become less bulky.

The tanks being the object of the invention and the weight and bulkiness of which is much more reduced as compared with the trucks for rehabilitation machines of the known art, are adapted to enable not only an easy transport by railway but also an easy road transport and a transport by sea or by air.

The tank and truck being the object of the invention can therefore ensure more flexibility of use as compared with the trucks of known type.

The possibility of retracting the second conveyor, in addition to reducing the sizes of the tank thereby facilitating transport of same, allows use of the last safety railway truck to be avoided so that the rear trucks already filled with the debris can be moved away with ease, said truck being on the contrary present in the trains of the known art.

Finally, the possibility of adjusting the orientation of the second conveyor improves the efficiency of the rehabilitating operation.

The invention claimed is:

1. A tank for transport railway trucks for railroad rehabilitation machines, comprising:

a holding structure (5) mainly extending along a predetermined direction (X);

at least one first conveyor (8) mounted within the holding structure (5) to transport incoherent material along the predetermined direction (X) internally of the holding structure (5), between an inlet region (9) to said holding structure (5) and an outlet region (10) from said holding structure (5);

means for laying the holding structure (5) on a railway truck (3) in a removable manner; and means (23) for hooking the holding structure (5) to the railway truck (3) in a removable manner, wherein the tank further comprises auxiliary thrust means (21) for the incoherent material, which auxiliary means (21) is movable along the transport direction (X) and, at least during its moving forward from the inlet region (9) to the outlet region (10), extends over a rest surface (12) of said first conveyor (8), to interfere with the incoherent material, and wherein the auxiliary thrust means (21) comprises a plurality of lugs extending transversely of the transport direction (X) at least during moving forward from the inlet region (9) to the outlet region (10), said lugs being movable in a reciprocating manner along the transport direction (X); and said lugs during the reverse motion from the outlet region (10) to the inlet region (9) lying in side by side relationship with the rest surface (12) not to interfere with the incoherent material.

2. A tank as claimed in claim 1, wherein the holding structure (5) has an extension along the transport direction (X) shorter than the length of a standard railway truck (3) to enable said holding structure to be carried on said standard railway truck (3).

3. A tank as claimed in claim 1, wherein the extension of the holding structure (5) along the transport direction (X) is 12 meters long or shorter to enable installation of same on a platform of a road transport truck.

4. A tank as claimed in claim 1, wherein the tank further comprises a second conveyor (16) secured to said holding structure (5) close to the outlet region (10) to transport the incoherent material carried by the first conveyor (8) away from said outlet region (10).

5. A tank as claimed in claim 4, wherein the second conveyor (16) is movable between a first operating position, at which it projects in cantilevered fashion from the holding structure (5), and a second operating position at which it lies retracted in said holding structure (5).

6. A tank as claimed in claim 4, wherein the second conveyor (16) can be orientated relative to the holding structure (5) and to the first conveyor (8) to enable discharge of the incoherent material at any place close to the outlet region (10).

7. A tank as claimed in claim 5, wherein in the second operating position wherein has an extension along the transport direction (X) shorter than the length of a standard railway truck (3) to enable it to be carried on said standard railway truck (3).

8. A tank as claimed in claim 5, wherein in the first operating position the holding structure (5) together with the second conveyor (16) have an extension along the transport direction (X) longer than the length of a standard railway truck (3) to enable operation of same on said standard railway truck (3).

9. A tank as claimed in claim 5, wherein in the first operating position the holding structure (5) together with the second conveyor (16) have an extension along the transport direction (X) exceeding 14 meters, to enable operation of same on a railway truck that is 14 meters long.

10. A tank as claimed in claim 5, wherein in the first operating position the holding structure (5) together with the second conveyor (16) have an extension along the transport direction (X) exceeding 19 meters, to enable operation of same on a railway truck that is 19 meters long.

11. A tank as claimed in claim 1, wherein the first conveyor 8 has a rest surface (12) for the incoherent material that is inclined from bottom to top starting from the inlet region (9) towards the outlet region (10).

12. A tank as claimed in claim 4, wherein the second conveyor (16) comprises a supporting frame (18) for a second conveyor belt (17) and third and fourth rollers.

13. A tank as claimed in claim 12, wherein the supporting frame (18) is movable between a first extended position external to the holding structure (5) corresponding to the first position of the second conveyor (16), and a second retracted position in said holding structure (5) corresponding to the second position of the second conveyor (16).

14. A tank as claimed in claim 12, wherein the supporting frame (18) is movable around a first horizontal axis (A) placed in the vicinity of the outlet region (10) to enable inclination of the second conveyor belt (17) from bottom to top starting from the first conveyor (8) and allow discharge of the incoherent material into an adjacent tank (2).

15. A tank as claimed in claim 14, wherein the supporting frame (18) is movable around a second vertical axis (B) placed in the vicinity of the outlet region (10) to enable rotation of the second conveyor belt (17) in a horizontal plane.

16. A tank as claimed in claim 15, wherein the supporting frame (18) is movable around a third axis (C) orientated along the longitudinal extension of the second conveyor belt (17) to cause inclination of said belt (17) and prevent the coherent material from falling, due to an inclination of the tank (2).

17. A tank as claimed in claim 16, wherein the second conveyor belt (17) has a rest surface (17*a*) for the incoherent material and in that said rest surface (17*a*) is susceptible of twisting around the third axis (C) to prevent the incoherent material from falling, due to an inclination of the tank (2).

18. A tank as claimed in claim 1, wherein the tank further comprises a chute (13) mounted close to the inlet region (10) to facilitate feeding of the incoherent material to the first conveyor (8); and a box-shaped structure (14) mounted close to the inlet region (9) for holding at least one motor operatively connected to the first conveyor (8).

19. A tank as claimed in claim 18, wherein the box-shaped structure (14) is placed at a raised position relative to the first conveyor (8), and the chute (13) is defined by a wall of said box-shaped structure (14), the box-shaped structure (14) being movable between a first position at which it lies fully contained in the holding structure (5) and over the first conveyor (8) to facilitate transport of the tank (2), and a second position at which it lies at least partly out of said holding structure (5) to enable full utilisation of the first conveyor (8).

20. A tank as claimed in claim 1, wherein the holding structure (5) comprises a pair of opposing side walls (7*a*) extending along the transport direction (X) at the sides of the first conveyor (8); the side walls (7*a*) having a hopper-like conformation and diverging from each other on moving away from the first conveyor (8).

21. A tank for transport railway trucks for railroad rehabilitation machines, comprising:

a holding structure (5) mainly extending along a predetermined direction (X);

at least one first conveyor (8) mounted within the holding structure (5) to transport incoherent material along the predetermined direction (X) internally of the holding structure (5), between an inlet region (9) to said holding structure (5) and an outlet region (10) from said holding structure (5);

means for laying the holding structure (5) on a railway truck (3) in a removable manner; and means (23) for hooking the holding structure (5) to the railway truck (3) in a removable manner, wherein the tank further comprises a chute (13) mounted close to the inlet region (10) to facilitate feeding of the incoherent material to the first conveyor (8); and a box-shaped structure (14) mounted close to the inlet region (9) for holding at least one motor operatively connected to the first conveyor (8), and wherein the box-shaped structure (14) is placed at a raised position relative to the first conveyor (8), and the chute (13) is defined by a wall of said box-shaped structure (14), the box-shaped structure (14) being movable between a first position at which it lies fully contained in the holding structure (5) and over the first conveyor (8) to facilitate transport of the tank (2), and a second position at which it lies at least partly out of said holding structure (5) to enable full utilisation of the first conveyor (8).

* * * * *